United States Patent [19]

Vignoni

[11] Patent Number: 5,048,313

[45] Date of Patent: Sep. 17, 1991

[54] CIRCULAR KNITTING MACHINES WITH THREAD GUIDE HAVING SUPPORT CAM FOR YARN

[75] Inventor: Cesare Vignoni, Brescia, Italy

[73] Assignee: Vignoni S.r.l., Gividino, Italy

[21] Appl. No.: 387,932

[22] Filed: Jul. 31, 1989

[30] Foreign Application Priority Data

Aug. 4, 1988 [IT] Italy ..... 5200 A/88

[51] Int. Cl.[5] ..... D04B 9/02; D04B 15/48

[52] U.S. Cl. ..... 66/141; 66/107

[58] Field of Search ..... 66/141, 142, 107

[56] References Cited

U.S. PATENT DOCUMENTS

| | | | |
|---|---|---|---|
| 2,759,344 | 8/1956 | Clark et al. | 66/141 |
| 3,221,521 | 12/1965 | Mishcon | 66/107 |
| 3,672,186 | 6/1972 | Rab | 66/141 |
| 3,817,058 | 6/1974 | Lombardi | 66/107 X |
| 4,040,276 | 8/1977 | Koegel | 66/107 |
| 4,103,518 | 8/1978 | Lombardi et al. | 66/107 |
| 4,592,215 | 6/1986 | Belk | 66/141 X |

FOREIGN PATENT DOCUMENTS

| | | | |
|---|---|---|---|
| 2711881 | 9/1977 | Fed. Rep. of Germany | 66/141 |
| 0717181 | 2/1980 | U.S.S.R. | 66/141 |
| 2033931 | 5/1980 | United Kingdom | 66/141 |

*Primary Examiner*—Werner H. Schroeder
*Assistant Examiner*—John J. Calvert
*Attorney, Agent, or Firm*—McGlew & Tuttle

[57] ABSTRACT

The invention relates to an improved knitting machine, either with latch needles or with compound needles, in which for each feeding station a thread guide is provided which is placed at a certain distance above the rising zone of the needles and is fitted with a horizontal supporting cam preventing the thread from fluttering while it is fed. The sinkers of the machine are fitted with an additional bearing surface designed to support the thread as it is fed by the thread guide till it is picked up by the needles on their down path immediately after their upward motion.

7 Claims, 4 Drawing Sheets

FIG.5a
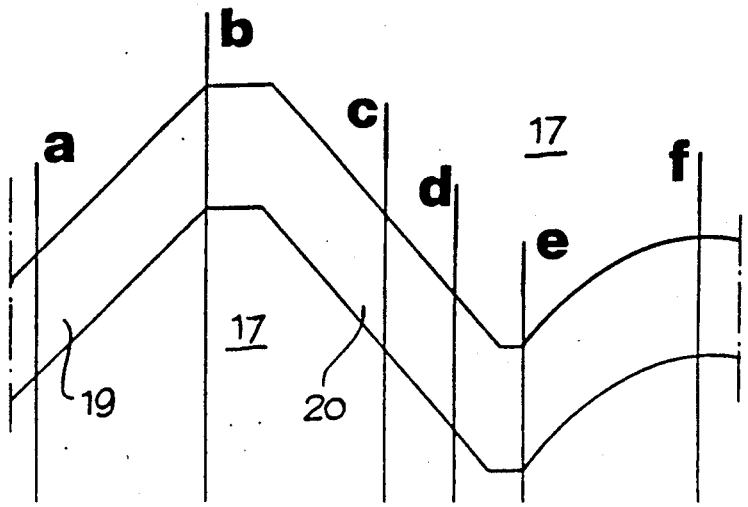
FIG.5b
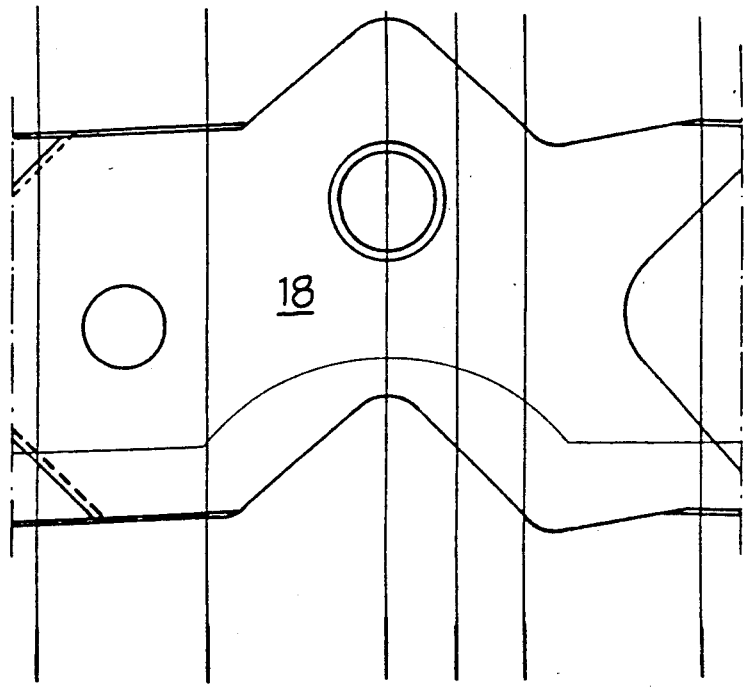
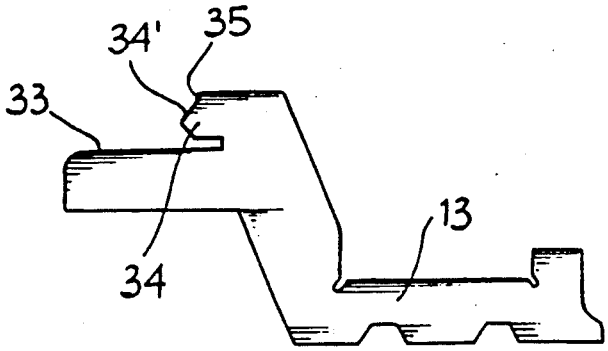
Fig. 4

CIRCULAR KNITTING MACHINES WITH THREAD GUIDE HAVING SUPPORT CAM FOR YARN

FIELD OF THE INVENTION

The present invention relates to improvements on knitting machines using compound needles or latch needles and, in particular to improvements on the means used to feed the yarn to be knitted on the machines.

BACKGROUND OF THE INVENTION

On circular knitting machines the yarn to be knitted is fed by means of thread guides. These thread guides are normally positioned within the zones where the needles are first lifted and are then lowered to catch the yarn and are at any rate maintained within at the highest level reached by the needles during their upward motion. It is however known that this position of the thread guides in respect to the needles may prevent a correct positioning of the yarn to be picked up by the needles. Such positioning may also create some problems of interference and wear of the needles themselves. These problems are inconveniences already arise when using latch needles where the moving latch is usually able to recover the yarn even if it is misplaced with such an arrangement the yarn is put into the latch of the relevant needle while it is moving downward to cast off the previous loop; however these problems are much worse when using compound needles without a latch to recover that position of an incoming yarn.

IMPROVEMENTS FOR CIRCULAR KNITTING MACHINES

SUMMARY AND OBJECTS OF THE INVENTION

It is the object of the present invention to solve the above mentioned problems and to improve the feeding conditions of the yarn on circular knitting machines an din particular to eliminate the inconveniences due to interference and wear of the needles caused by the thread guides on conventional machines.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

The present invention therefore relates to a knitting machine comprising a plurality of vertical needles fitted to the periphery of a rotating cylinder. These needles cooperate with an equal number of sinkers or any other lowering element means to knit the years as they are fed to a plurality of feeding stations distributed all around the cylinder. The needles are vertically displaced up and down by suitable cams, while the sinkers or the like are horizontally displaced by input and output cams. According to the present invention such a machine is characterized in that:

for each feeding station a thread guide is placed at some distance above the rising zone of the needles; and, each thread guide is fitted with at least one guide bush, substantially radial to the cylinder, and with one inward supporting cam, flush with said bush, to hold the yarn as it is fed and as it extends towards the rising zone of the needles, substantially in a vertical plane in a direction which is parallel to the circumference of the cylinder.

Further, according to the invention, each down sinker presents at least one additional bearing surface to support the yarn fed by the thread guide, even beyond said supporting cam and up to the point where the thread is taken in by the needles during their downward motion following the rising zone immediately after the thread guide.

The invention may be applied to circular knitting machines both with compound and with latch needles, as well as to machines with a single or double knitting head and needles or other knitting elements.

By placing the thread guides outside the operative zone of the needles, the above mentioned problems due to interference and wear are eliminated. The presence of a supporting cam flush with the guide bush and extending towards the rising zone of the needles has the advantage of eliminating any kind of fluttering, vibration or oscillation of the yarn. This arrangement also keeps the yarn in such a position that the rising needles will not touch it, while the yarn will be taken to the correct position to be engaged by the beak of the needles while they are moving downward.

The purpose of the additional bearing surface of each sinker or the like is to support the function of the cam carrying the thread guide in order to prevent the yarn from oscillating and in particular to keep the incoming yarn at the correct level to be surely picked up by the beak of the needles during their downward motion to form the loops.

After that the sinker or the like returns to allow the yarn to go down on the usual looping plane and to form loops according to the standard sequence. All these measures have the additional advantage of allowing the feeding of the yarn at a much lower tension than that usually required, thus reducing the risk of thread breakages.

The machine built according to the present invention features some other improvements, which will be more apparent from the following description of the machine with radially moving horizontal sinkers. This description does not exclude the possibility of applying the invention to machines fitted with vertical sinkers moving in a different way.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

In the drawings:

FIG. 4 is a side view of a sinker with additional supporting surface;

FIG. 5*a* is a view showing the corresponding cams controlling the up and down movements of the needles;

FIG. 5*b* is a view showing the corresponding cams controlling the egress and ingress for the sinkers;

DESCRIPTION OF THE PREFERRED EMBODIMENTS

Figure 1:
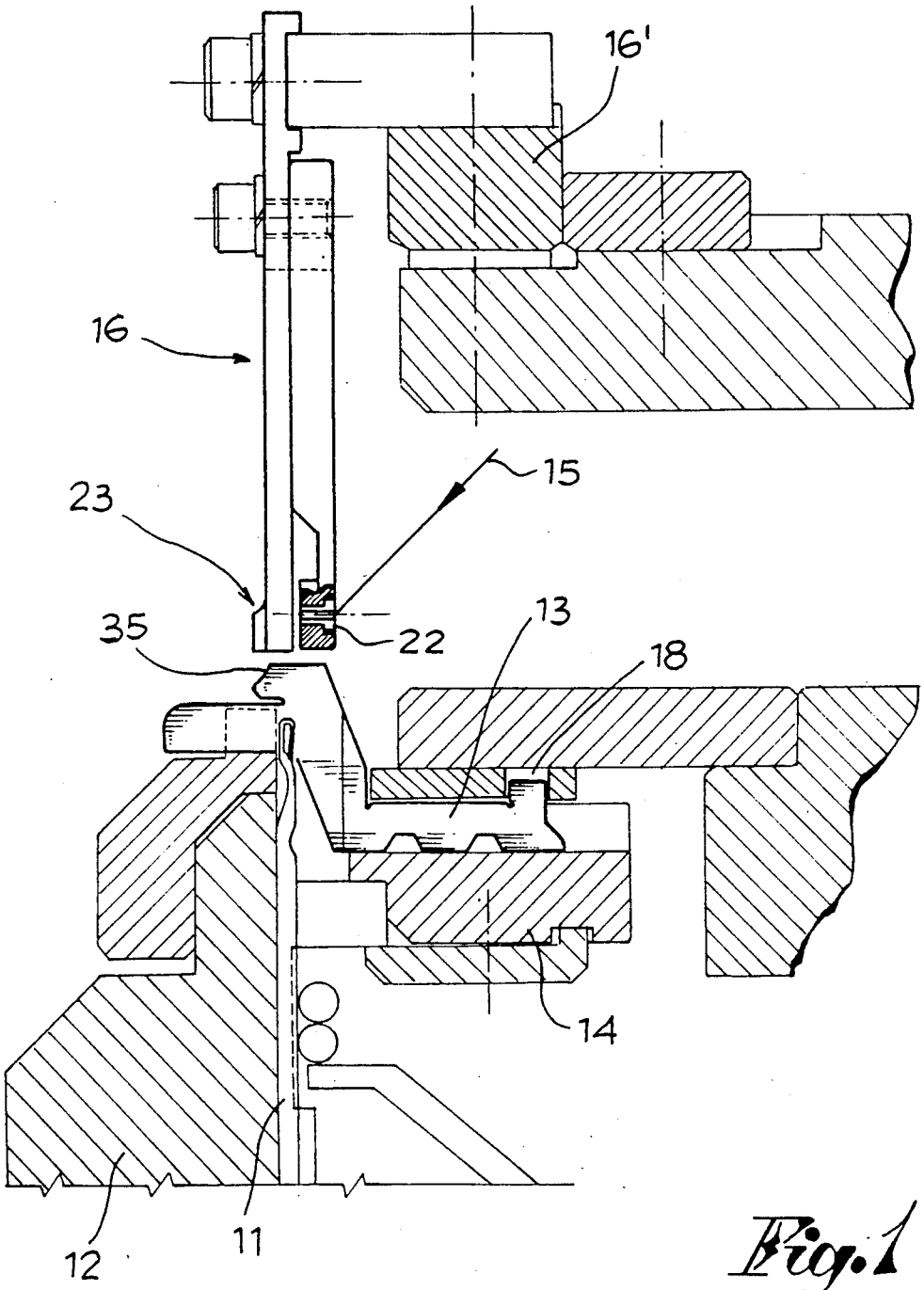
FIG. 1 is a partial vertical sectional view of a schematically represented knitting machine fitted with thread guides.

The represented Circular knitting machine comprises, like any other machine of the kind, at least a plurality of needles 11 mounted an vertically guided on the periphery of a rotating cylinder 12 and cooperating with an equal number of intercalated down sinkers 13 assembled on a bearing ring 14 fitted on cylinder 12 and turning with same. Needles 11 and sinker means or sinkers 13 interact to knit threads 15 which are fed in a number of feeding stations distributed around cylinder 12. Each of the feeding stations includes a thread guide 16, the different thread guides being mounted on a stationary ring 16.

The needles ma of the type featuring a hook or top portion 11' and a latch 11'' to open and close the top position 11' as shown in the drawing or of the latch type (not shown). In any case the needles 11 are operatively displaced by stationary up and down cams 17 assigned to each feeding station (see FIG. 5*a*). The sinkers 13 are displaced by stationary egress and ingress cams 18 (see FIG. 5*b*) and the sinker cams. The up and down paths 19, 20 respectively of the needles 11 are also schematically shown in FIG. 3, where arrow (F) indicates the sense of rotation of the cylinder.

According to the present invention, the thread guide 16 for each feeding station is placed at some distance above (see FIG. 3) the rising zone 19 of needles 11 in the corresponding feeding station. In other words, each thread guide 16 is placed above the c needles in an intermediate position between two consecutive needle rising zones 19 and in any case outside the operative zone of the needles.

Figure 2:
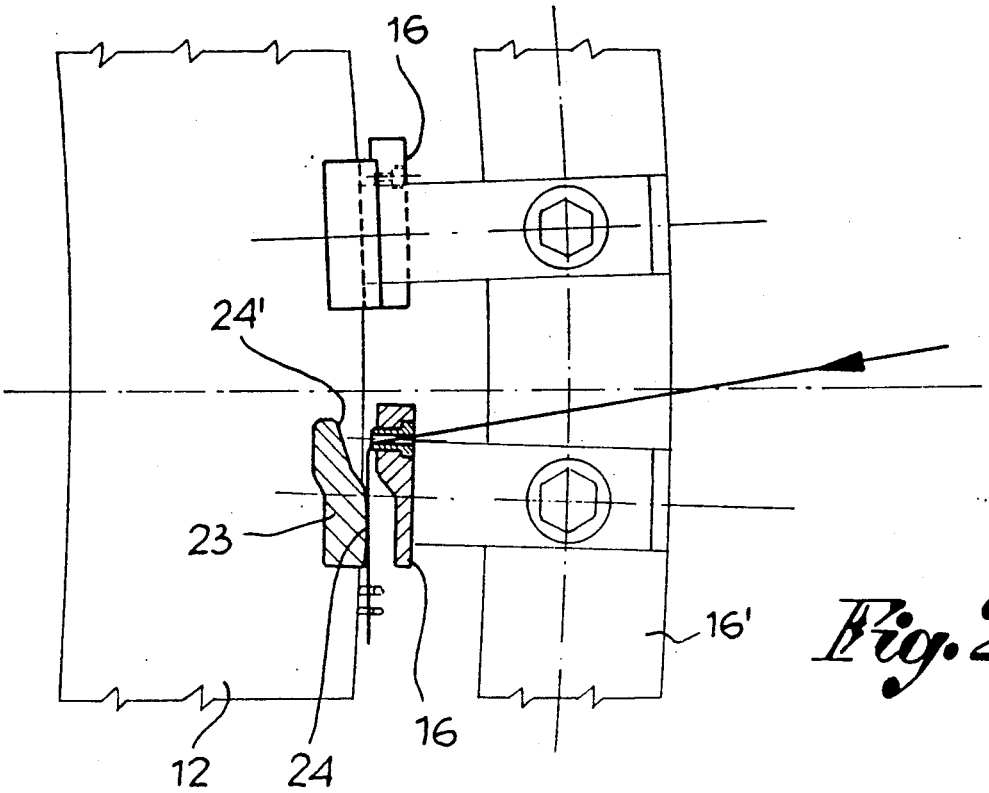
FIG. 2 is a top view of the detail shown in FIG. 3, with three consecutive thread guides.
Figure 3:
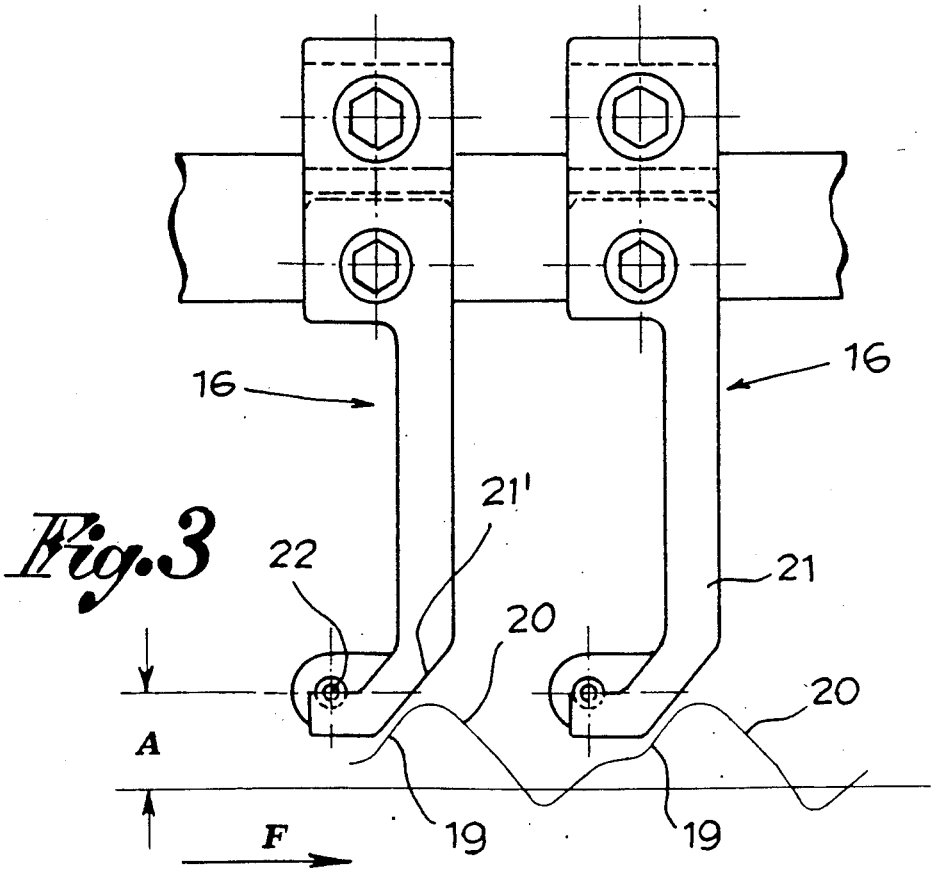
FIG. 3 is a partial vertical sectional view with the thread guides inside the machine.

Each thread guide comprises a substantially vertical supporting stem 21 with at least one guiding bush 22 fitted to its bottom end at a given level "A" above the sinkers 13 and radially directed towards the cylinder. At the bottom end of stem 21 a supporting cam 23 is fixed, which is substantially a the same level as bush 22 and has a front surface against which the thread 15, fed through said bush 22, is obliged to rest. The front surface 24 of supporting cam 23 is vertically directed and parallel to the outer circumference of cylinder 12, from which it is displaced to some extent as shown in FIG. 2. In addition, the front surface 24 of the supporting cam 23 extends approximately from guiding bush 22 towards the upward path 19 of needles 11, nearly to the top of said upward path. Surface 24 may also present an initial bevel 24' on its end facing guiding bush 22, while stem 21 may have a bevel 21' at its bottom end directed to the upward path 19 of needles 11, as shown in FIG. 3, in order to prevent eventually broken needles from interfering with the thread guide.

As mentioned above, the supporting cam 23 prevents the thread 15 coming from bush 22 and travelling towards the needles in their upward path 19 from fluttering and also keeps threads outside the needles to allow the latter to surely pass behind the thread and thus catch it by their top portion 11' when coming down, exactly as requested.

Sinkers 13 are in turn supporting the operation of thread guide cams 23 in correctly guiding the thread 15 towards the needles 11.

To this purpose each sinker 13 is fitted, above its normal working face 33, with at least one more portion 34 which is shorter than the working face and including a beveled portion 34' while its top 35 is designed to support the thread 15 coming from thread guide 16 and moving toward the rising needles (see FIGS. 6 and 7) which will move downward immediately after said thread guide. The sinkers are controlled by cams 18 (see FIG. 5) in such a way that their nose portion 34 is placed below the thread coming from the thread guide end will go back only when the thread is going to be caught by the needle top portion 11'.

Figure 6:
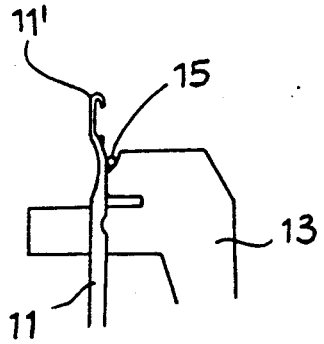
FIG. 6–11 are views showing some positions of a sinker with reference to the operating motions of a needle and corresponding to positions a, b, c, d, e, f, in FIG. 5.
Figure 7:
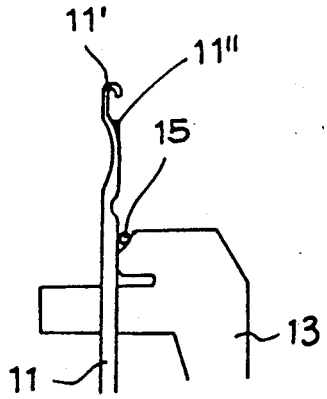
Figure 11:
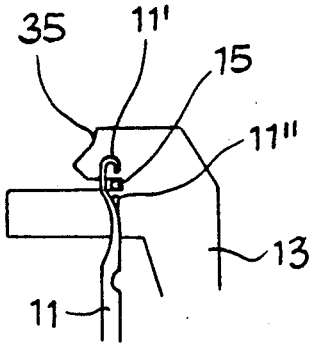

The additional top face 35 of each sinker 13 supports the thread 15 to prevent it from unduly fluttering along the whole path from thread guide 16 to the down path 20 of the needles, where it will be picked up as shown in FIGS. 6 and 11 representing some positions of sinker and needle corresponding to a, b, c, d, e, f in FIGS. 5*a* and 5*b* along the path of the two elements as it is defined by the relevant cam.

Thus the above stated purposes and advantages are achieved owing to an "eccentric" position of the thread guides in respect to the peak of the upward path of the needles in the various feeding stations.

As the thread is caught by the needle top portion 11' the sinkers more rearwards and progressively release the thread while accompanying it to the needle beak by means of their bevel 34'.

Figure 8:
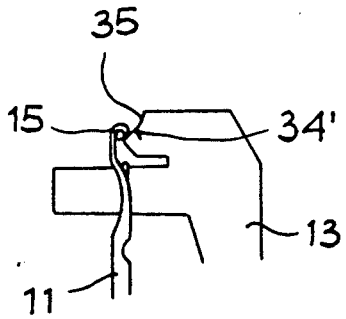
Figure 9:
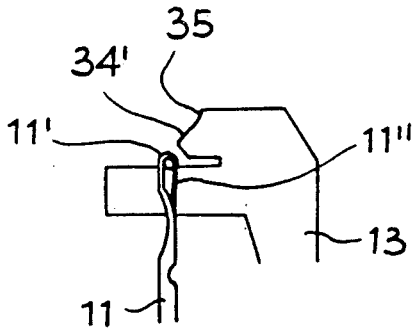
Figure 10:
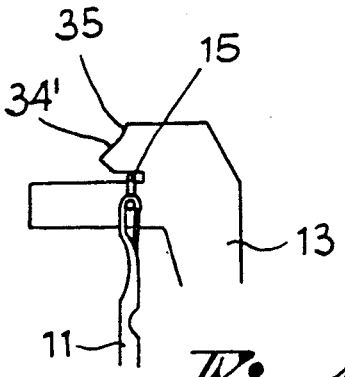

The thread, once it is taken in by the needle top portion 11' and slipped down from bevel 34' (see FIGS. 8 and 9) may rest on face 33 of the sinkers to be knitted in conventional manner (see FIGS. 10 and 11).

In addition, the thread guides may be used as an electric circuit to check eventual needle breakages, holes in the knitted fabric or to any other useful purpose and to stop the machine through an additional control circuit as soon as a needle breaks or as a mesh is faulty, any fault being immediately detected in any point of the cylinder circumference.

While a specific embodiment of the invention has been shown and described in detail to illustrate the application of the principals of the invention, it will be understood that the invention may be embodied otherwise without departing from such principals.

I claim:

1. A knitting machine, comprising:

a cylinder arrangement with a plurality of needles, each needle having hook and a latch, each needle being displaceable within a rising zone;

sinker means including a plurality of intercalating elements, each intercalating element cooperating with a needle to knit threads and having a normal working face and a nose portion extending above said working face and having a length shorter than said working face, said working face and said nose portion defining an interweaving gap, said nose and said working face cooperate for controlling the feeding thread;

lifting and lowering cam means for displacing ones of said plurality of needles;

ingress and egress cam means for individually displacing ones of said plurality of intercalating elements; and, a plurality of thread feed stations each feed station including a thread guide positioned at a distance above the rising zone of said needles, each thread guide including at least one guide bush positioned facing a radial direction of said cylinder and said thread guide including an inward supporting cam flush with said bush, said inward supporting cam including front bearing means for holding the yarn as it is fed, said front bearing means extending towards the rising zone of said needles substantially in a vertical plane in a direction which is parallel to the circumference of the cylinder.

2. A machine according to claim 1, wherein each thread guide is placed in an intermediate position between two needle rising zones, said front bearing means of said inward supporting cam of said thread guide extending to the outside of the circumference of the cylinder, said front bearing means presenting an initial bevel on a side facing said guiding bush.

3. A knitting machine, comprising:

a cylinder arrangement with a plurality of needles, each needle being displaceable within a rising zone;

sinker means including a plurality of intercalating elements, each intercalating element cooperation with a needle to knit threads and having a normal working face and a nose portion extending above said working face and having a length shorter than said working face, said working face and said nose portion cooperating to define an interweaving gap, said nose and said working face cooperate for controlling the feeding thread;

lifting and lowering cam means for displacing ones of said plurality of needles;

ingress and egress cam means or individually displacing ones of said plurality of intercalating elements;

a plurality of thread feed stations each thread feed station including a thread guide positioned at a distance above the rising zone of said needles, each thread guide including at least one guide bush positioned facing a radial direction of said cylinder and said thread guide including an inward supporting cam flush with said bush, said inward supporting cam including front bearing support means for holding the yarn as it is fed, said front bearing means extending towards the rising zone of said needles substantially in a vertical plane in a direction with is parallel to the circumference of the cylinder, each intercalating element including a support surface and additional supporting surface means for supporting a thread coming from a thread guide beyond said inward supporting cam to a point at which the thread is caught by a needle in the rising zone immediately after the thread guide.

4. A knitting machine comprising:

A plurality of needles for knitting threads; a plurality of feeding stations; lifting and lowering cam means for displacing ones of said needles; egress and ingress cam means for displacing said sinkers; said sinkers each including an additional supporting surface for supporting the thread issuing from said thread guide, said sinker supporting surface supporting said thread from a point that the thread is caught by said needles along the rising zone of said needle to a point at which the thread issues from said thread guide, said thread guide forming an electric circuit for stopping the machine in case of needle breakage or faulty knitting.

5. A machine according to claim 3 or 4, wherein said additional supporting surface of each sinker includes a beak with a top section positioned above a normal working face of said sinker, said top section being shorter than the length of said sinker.

6. A machine according to either claim 3 or 4 wherein said ingress and egress cam means moves said sinker rearwardly to remove the additional supporting surface from the thread as soon as the thread is engaged by a beak of the needle while the needle is moving downwardly.

7. A knitting machine, comprising:

a cylinder arrangement with a plurality of needles, each needle having a hook and a latch, each needle being displaceable within a rising zone;

sinker means including a plurality of intercalating elements, each intercalating element cooperating with a needle to knit threads;

lifting and lowering cam means for displacing ones of said plurality of needles;

ingress and egress cam means or individually displacing ones of said plurality of intercalating elements; and, a plurality of thread feed stations each feed station including a thread guide positioned outside of said rising zone and above said needles, each thread guide including at least one guide bush positioned facing a radial direction of said cylinder and said thread guide including an inward supporting cam flush with said bush, said inward supporting cam including front bearing means for holding the yarn as it is fed, said front bearing means extending towards the rising zone of said needles substantially in a vertical plane in a direction which is parallel to the circumference of the cylinder.

* * * * *